United States Patent [19]

Wright

[11] 4,130,991

[45] Dec. 26, 1978

[54] HYDRAULIC PUMPS

[76] Inventor: Howard S. Wright, 436 Devon St. W., New Plymouth, New Zealand

[21] Appl. No.: 809,164

[22] Filed: Jun. 23, 1977

[30] Foreign Application Priority Data

Jun. 23, 1976 [NZ] New Zealand ..... 181253

[51] Int. Cl.[2] ..... F15B 15/18

[52] U.S. Cl. ..... 60/477; 60/482; 254/93 R; 417/443

[58] Field of Search ..... 60/477, 479, 481, 482; 417/443; 254/89 H, 93 R, 93 H

[56] References Cited

U.S. PATENT DOCUMENTS 2,557,880 6/1951 Lynn ..... 60/477 X 3,464,204 9/1969 Rudkin ..... 60/482

3,615,157 10/1971 Trotta ..... 60/482 X

*Primary Examiner*—Edgar W. Geoghegan

[57] ABSTRACT

An hydraulic pump comprising a plunger slidingly located within a housing. A first valve is adapted to allow fluid to be drawn from a reservoir into the housing during movement of the plunger in one direction, and a second valve is adapted to allow fluid to flow from the housing during the greater part of movement of the plunger in its other direction. A control apparatus is provided to control the second valve at or near the completion of the plunger's movement in the mentioned other direction to allow fluid to move back through the second valve and into the reservoir.

20 Claims, 5 Drawing Figures

HYDRAULIC PUMPS

This invention relates to a hydraulic pump and is mainly, but not solely, designed for use in the raising and lowering of a hospital or like bed. Whilst the following description will, for ease of reference, refer to a hosipital bed the pump has many other applications for instance, for elevating chairs, draughting tables or general use as a linear actuator in the automotive, industrial and agricultural machinery fields.

A modern hospital bed is constructed so that the mattress base can be elevated or lowered and also contoured to provide sitting positions as well as head up or foot up configurations. To facilitate this movement the base is mounted on arms which are controlled usually by one or more hydraulic cylinders. Such a bed is described in New Zealand Patent Specification No. 165412. Means to operate and control the movement of the bed base are provided and these usually consist of one or more hydraulic pumps and a series of foot pedals. Each foot pedal controls a particular action of the bed and those pedals are conveniently positioned at the head or foot of the bed. Certain disadvantages arise by using a number of pedals one being cost, but more importantly the need for the operator to know which pedal to operate for a particular function with the associated problem that accidently the wrong pedal could be operated.

Broadly the present invention consists of a hydraulic pump comprising a plunger slidingly located within a housing, first valve means adapted to allow fluid to be drawn from a reservoir into the housing during movement of the plunger in one direction, second valve means adapted to allow fluid to flow from the housing during the greater part of movement of the plunger in its other direction and means to control the said second valve at or near the completion of the plunger's movement in said other direction to allow fluid to move back through said second valve means and into the reservoir.

In the accompanying drawings, to which reference will be made in the following disclosure;

Figure 1:
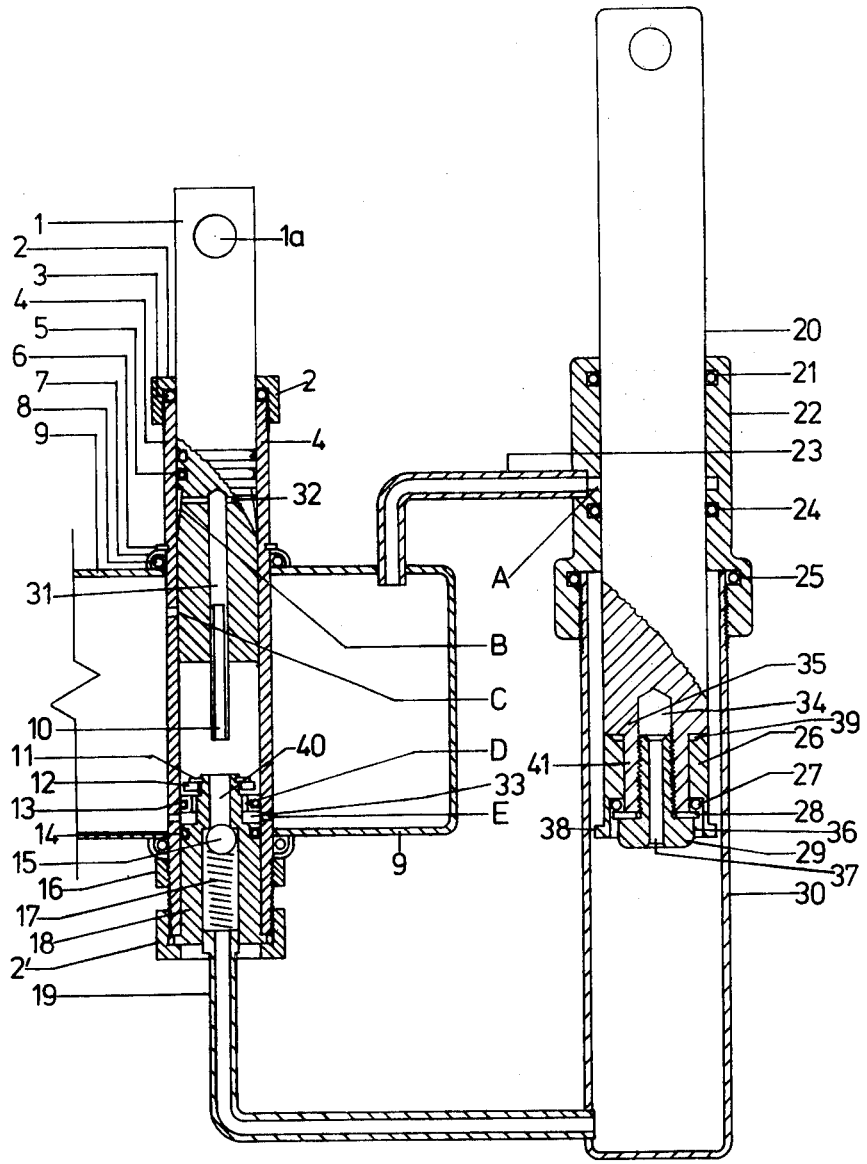
FIG. 1 is a sectional side view of the pump according to the invention.

All of the figures of the drawings are largely schematic to show the essential constructional features and hydraulic circuitry of the invention. It will, however, be evident to those skilled in the art that the plunger is actuated by a simple hand lever or foot pedal.

The Plunger 1 has a hole or slot 1*a* at its top end to facilitate connection to a suitable actuating lever (not shown) as dictated by the function the pump is to perform. Its lower end has a centre drilling 31 which extends for approximately one third of the plunger's length. A cross drilling 32 connects this drilling 31 to a taper B machined in the peripheral surface of the plunger 1. Immediately above this tapered recess B the plunger 1 is provided with a seal or seals 5 located in groove(s). A tension pin 10 is driven to a predetermined depth within drilling 31. The tension pin 10 sometimes called a roll pin, is of spring material, tubular in shape but is not a closed tube as it has a gap or split along its length. The plunger 1 is a close fit within the pump cylinder 4 so that in use it maintains a strong suction stroke.

The functions of the plunger are (a) To charge the pump cylinder 4 with oil by drawing this in form the reservoir 9 on its up stroke.
(b) To force this charge of oil past check valve 15 on its down stroke (only 75% of total stroke is used for pumping oil as will hereinafter be described).
(c) To exhaust oil from beyond the check valve 15 using the last 25% of available stroke.

The Pump Cylinder 4 is made from suitable tubular material threaded at each end. The thread at the top end allows the nut 2 to retain seal 3 in position. The thread at the bottom end has two functions. It allows fitment of another identical nut 2' which retains the valve 18 and secures the whole pump in place in the reservoir 9 via a nut 16 working against a circlip 6. The pump cylinder 4 is sealed to the reservoir 9 by means of an O ring 8 top and bottom of the reservoir which are contained in cup washers 7. Several holes are drilled around the lower end of the pump cylinder 4 to serve as inlet ports E and a single hole is placed at a distance above these to serve as the exhaust port C.

The Valve Assembly. The valve 18 is inserted in the bottom of the pump cylinder 4 and held there by nut 2'. It is sealed against oil leakage by O ring 14, a groove 33 is turned into the outside diameter corresponding with the level of the inlet holes at E. The nose of the valve 18 is stepped down to a diameter somewhat less than that of the inlet groove 33. A series of holes D are drilled around this stepped face into the inlet groove 33 allowing free passage of oil from the reservoir 9 into the chamber of pump cylinder 4. A small O ring 13 is installed immediately above the inlet groove 33 to prevent by-passing of oil at this point. A flap valve or disc of metal 12 is fitted to the stepped end of the valve 18 and entrapped by a circlip 11.

The flap valve 12 has considerable end float (up and down under the circlip 11) and it has ample clearance on the spigot and within the cylinder to facilitate free movement thereof. A hole 40 of two different diameters is drilled through the centre of the valve 18. The lesser diameter faces toward the plunger 1 and this is capable of accepting the tension pin 10. The larger diameter is threaded at the bottom end to facilitate connection of the high pressure line 19. The junction of the two diameters forms seat for check valve 15 element which is installed and held onto the seat by a light spring 17 retained by the high pressure line fitting.

The Cylinder is of the displacement type, there is no precise fit between piston 20 and cylinder 30 rather the reverse applies in that generous clearance is allowed. There is a precise fit between the cylinder end cap 22 and piston 20. It is presumed that a successful pressure joint is established between the cylinder 30 and its end cap 22.

The requirements of the end cap 22 are that it presents a long bearing surface for piston 20 and that it is of material which will resist wear and not harm the finish of the piston. A dust seal 21 is installed near the top of the end cap 22 and a piston seal 24 near the bottom. Immediately above the piston seal 24 a groove A is provided which is connected to a low pressure bypass line 23 coupled to the reservoir 9. The position of groove A in the end cap 22 is directly related to the dimensions of the piston shoulder bush 26 to be hereinafter described.

The end of the piston 20 that remains in the cylinder 30 is machined down to a lesser diameter to create a spigot 41. A hole 34 is drilled through the centre of spigot 41 and is provided with a thread. Hole 34 extends into piston 20 for a somewhat greater distance than the length of spigot 41. A hole 35 is drilled from the root of the spigot 41 into hole 34.

A shoulder bush 26 is fitted to the spigot and secured with a bolt 29, washer 28 and O ring 27. The free end of the bush 26 has a step or shoulder 38 which stops against the end cap 22 when maximum extension of the piston 20 has been reached. Its inside diameter allows a sliding fit on spigot 41 while its outside diameter (except for the shoulder 38) is identical to that of piston 20. A recess 36 is provided at the free end to accommodate the head of bolt 29 etc. and a relief 39 is machined into the face of the shoulder bush where this contacts the shoulder of the piston. The fixing bolt 29 has a centre hole 37 drilled right through it for the passage of oil.

It should be noted that the O ring 27 is used as a spring to return the shoulder bush 26, it is not an oil seal and could in fact be replaced by a metal spring.

Figure 2:
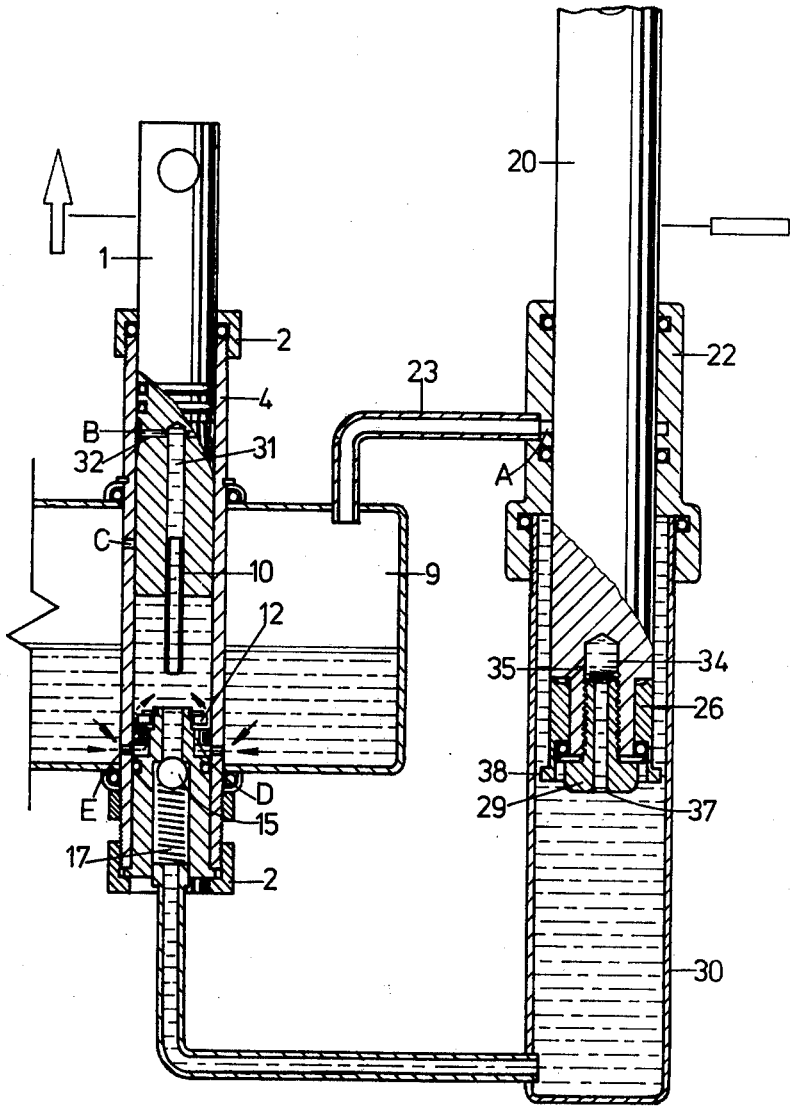
FIGS. 2 to 5 are similar sectional views showing the pump in various stages of its operation.
Figure 5:
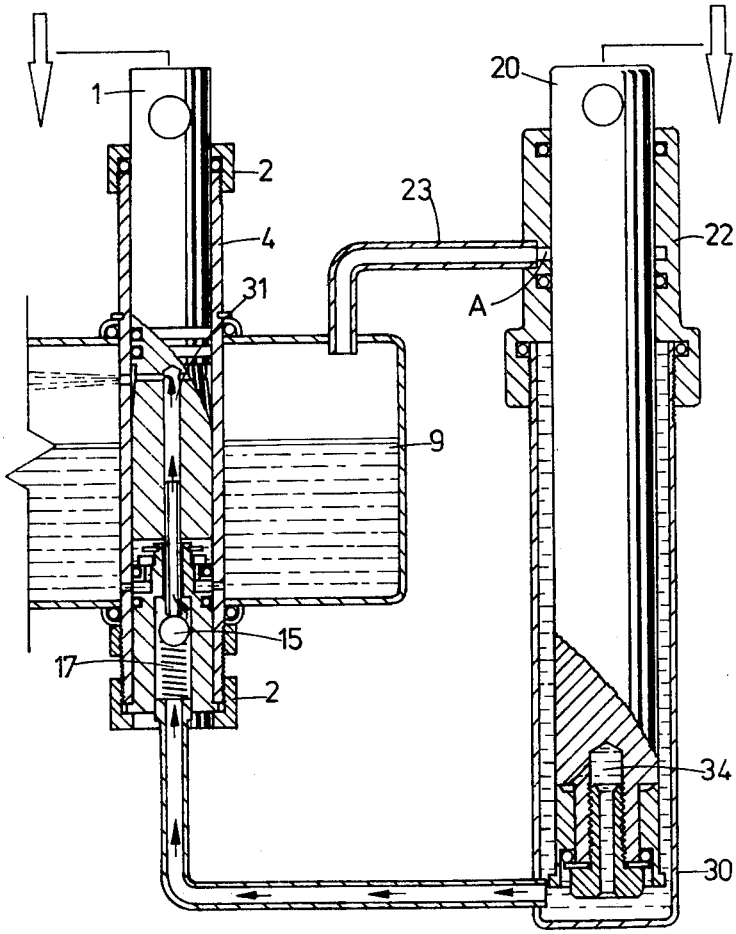

To explain the operation of the pump reference is made to FIGS. 2 and 5. In FIG. 2 (the suction stroke) the plunger 1 ascends drawing in a charge of oil from the reservoir via inlet holes E, groove 33 and axial holes D.

As plunger 1 rises pressure differences cause the flap valve 12 to also rise thus allowing oil to move freely from the reservoir 9, through the cylinder inlet holes E to the groove 33, then, via the radial group of holes D, to the pump cylinder 4.

Figure 3:
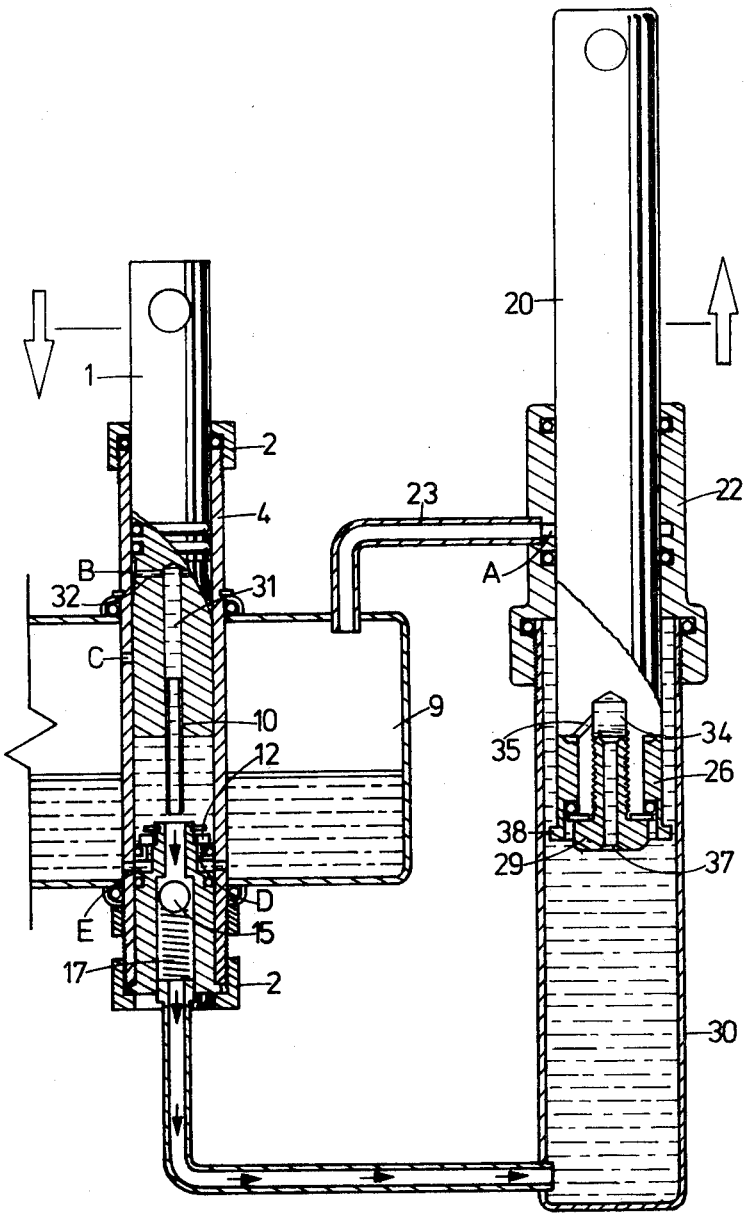

In FIG. 3 (the pumping stroke) as soon as the plunger 1 begins its downward stroke the movement of oil returns the flap valve 12 to its seat thereby closing off the inlet porting. Check valve 15 is forced off its seat by oil pressure allowing the oil to flow around it and to be transferred via the high pressure line 19 into the oil chamber of cylinder 30. Repeated strokes of the plunger 1 combine suction on the up stroke and pumping on the down stroke until ultimately the piston 20 reaches the shoulder stop at its maximum extension (FIG. 4).

Figure 4:
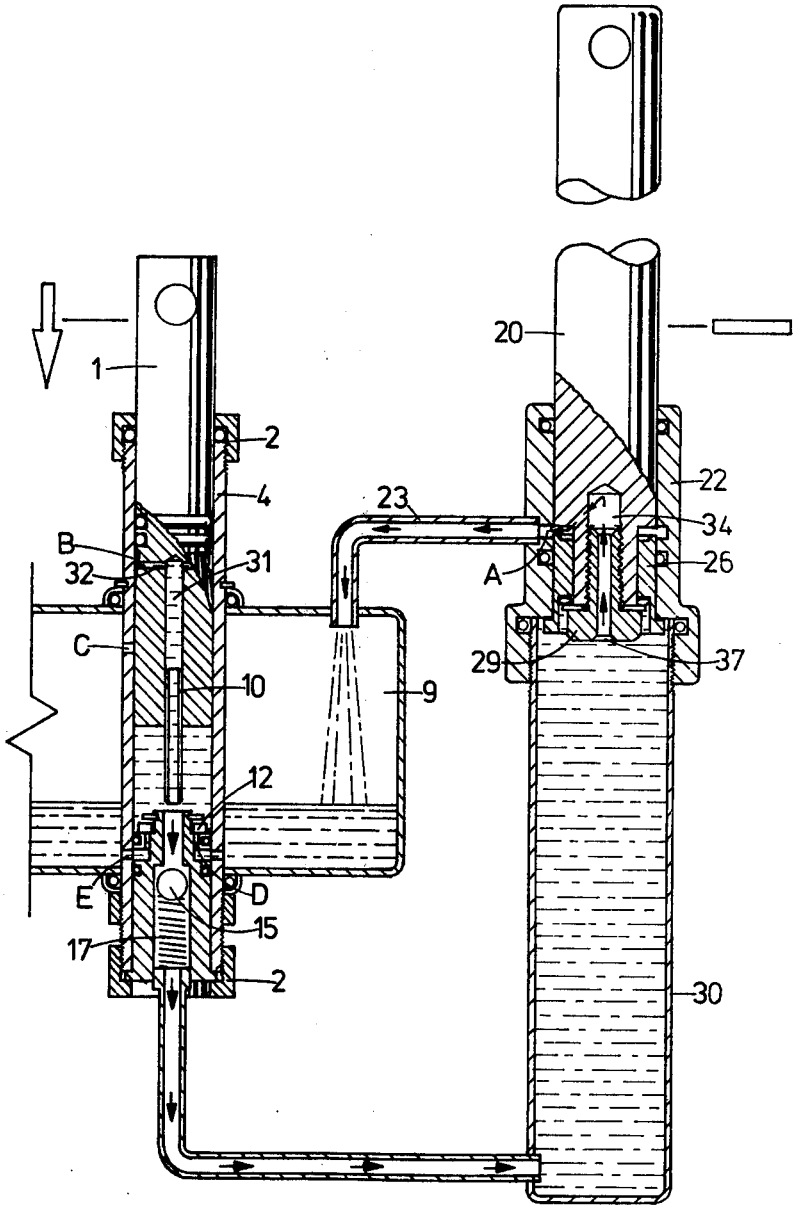

FIG. 4 shows the bypass circuit when the piston reaches maximum extension and surplus oil continuing to be pumped into cylinder 30 is able to pass through hole 37 and be ported back to reservoir 9.

Whilst a joint exists between the piston 20 and shoulder bush 26 there is no gap or step, therefore when piston 20 nears the maximum extension this joint passes over the piston seal 24 as though it were a smooth continuous surface. On reaching maximum extension shoulder 38 contacts the inner end of cap 22 and piston 20 stops. This could be in mid-stroke of the pump plunger in which case more oil will enter the cylinder 30.

The effect that this additional oil will have is to momentarily increase oil pressure slightly, then, acting against the shoulder at 39 (where piston 20 and shoulder bush 26 join), the piston 20 is carried forward against the resistance of the O ring 27 and a gap is opened up between piston shoulder 38 and shoulder bush 26. This gap now coincides with the groove A which allows the excess oil to freely escapte into the low pressure line 23 and return to the reservoir 9.

Repeated pump strokes will now only have the effect of opening the joint between piston shoulder 38 and shoulder bush 26 sufficiently to allow the excess oil in circulation to escape. When pumping ceases oil will continue to escape from the joint until the joint line has descended to and has been sealed off by piston seal 24. For this reason it is desirable to site seal 24 as close as possible to bypass groove A. It is now clear that whenever the metal to metal joint of the piston opens to exhaust oil it is in a safe position opposite groove A and that whenever it passes through seal 24 whether it be ascending or descending it is tightly closed and will not damage that seal.

FIG. 5 shows the exhaust circuit. When a foot pedal is used to actuate the plunger 1 a compression spring surrounding the top portion of the pump and plunger is necessary to obtain the up stroke of the plunger. Approximately 75% of the lever stroke is used to pump oil to the piston cylinder. The remaining 25% of stroke is used to operate the valve and return the oil. It follows that to extend the piston, repeated strokes of the lever are required but using only 75% of the total stroke. To retract the piston the lever is depressed to some point between 75% and 100% (depending on the speed of retraction required), and held there until the piston has retracted the required distance. It has been found that by siting a rubber block so that the lever comes into contact with this at the same time as it reaches the start of the valve position "feel" can be induced in the lever whereby a greater rate of retraction requires heavier pressure on the lever.

As shown in FIG. 5 the plunger is pressed down to a point between 75% and 100% of its stroke and the tension pin 10 contacts the ball 15 and carries it off its seat. Oil under pressure from the cylinder is now able to flow up through the tension pin 10 and the centre hole 31 through the cross drilling 32 and into the cavity formed by taper B.

The oil is prevented from escaping upwards by the plunger seals 5 and initially at least is prevented from exhausting because the full diameter of the plunger covers an exhaust port C. Further downward movement of the plunger 1 brings the 3° taper B into proximity with the exhaust port C and a limited amount of high pressure oil is able to return to the reservoir 9. As the plunger 1 continues its downward movement exhaust port C becomes progressively uncovered, then, because of the taper B, the oil passage to the port C becomes deeper, allowing progressively more oil to escape until a point is reached when the exhaust port diameter sets the rate of maximum flow.

Advantages of the pump according to the present invention are as follows:

Complete control by a single pedal or lever.
Variable rate of descent.
Bypass at limit of piston stroke.
Low Cost Manufacture.
Ease of Servicing.
A safe bypass mechanism that will not damage seals.
An almost total resistance to leakage.
Isolation of high pressure oil into an area that only exposes one organic seal to constant high pressure.
The simplicity of fitting and sealing the pump to the reservoir.
The practicality of using a tube as the reservoir in that a structural member can serve as the reservoir or vice versa.

As the primary function of this unit is to operate hospital equipment and that equipment is often used in carpeted areas, the maximum resistance to leakage of oil is necessary. In this circuit safety factors are incorporated which prevent the escape of oil due to faulty seals. It will be seen that the high pressure oil is contained between the check valve in the pump and the piston seal in the cylinder, both of these have escape routes which will return escaping oil to the reservoir. If the check valve should malfunction the high pressure oil cannot escape to the exterior surfaces because it is blocked by the plunger seals, instead it is diverted back to the reseervoir via the exhaust port. Similarly any oil escaping past the piston seal is arrested by the dust seal beyond it and diverted via the bypass circuit to the reservoir.

What is claimed is:

1. A hydraulic pump comprising:
a plunger slidingly located within a housing;
a reservoir;
first valve means located between said reservoir and housing and adapted to allow fluid to be drawn from the reservoir into the housing during movement of the plunger in one direction;
second valve means adapted to allow fluid to flow from the housing during the greater part of movement of the plunger in its other direction;
control means to open or retain open said second valve means when the plunger is near the completion of movement in said other direction and thus allow fluid to reverse flow through said second valve and into said housing;
a port in said housing which is in communication with said reservoir;
conduit means to direct said reverse flow to said port; and
regulating means to gradually increase the rate of said reverse flow through said port as the plunger is moved toward commpletion of its movement in said other direction.

2. A pump as claimed in claim 1 wherein the housing has at least an opening in the wall thereof via which fluid can be drawn from the reservoir, said first valve means being located to prevent fluid from flowing back into said housing through said wall opening.

3. A pump as claimed in claim 2 wherein the housing is at least partially located within the reservoir.

4. A pump as claimed in claim 2 wherein said second valve means is axially disposed from said plunger, said at least one opening being disposed between said second valve means and the plunger.

5. A pump as claimed in claim 4 wherein the second valve means is a spring loaded ball valve having a flow passage substantially coaxial with said plunger.

6. A pump as claimed in claim 1 wherein the first valve means is a flap valve consisting of a sealing member retained for restricted axial movement within the housing, a seating against which the sealing member engages at one limit of its movement, and at least one passageway through said seating which opens between said wall opening and the inside of the housing.

7. A pump as claimed in claim 4 wherein:
said conduit means comprises a central bore in said plunger, said bore extending from the end of the plunger within said housing and coupling at its inner end with a cross-bore extending through said plunger;
said control means comprises a pin with a longitudinal passageway located within but projecting from said central bore; and
said regulating means comprises a tapered recess into which said cross bore opens, the recess being formed in the outer peripheral surface of said plunger and positioned so that is communicates with said port as the plunger nears the end of movement in said other direction.

8. A pump as claimed in claim 7 wherein the pin opens said second valve means when the plunger has reached or nears the limit of movement in the said other direction.

9. A pump as claimed in claim 8 wherein the second valve means is opened by said pin when the plunger is moving within the final 25% of its stroke in the said other direction.

10. A pump as claimed in claim 9 wherein the plunger is coupled to a hand lever or foot pedal.

11. A hydraulic pump comprising:
a plunger slidingly located within a housing;
a reservoir;
first valve means located between said reservoir and housing and adapted to allow fluid to be drawn from the reservoir into the housing during movement of the plunger in one direction;
second valve means adapted to allow fluid to flow from the housing during the greater part of movement of the plunger in its other direction;
control means to open or retain open said second valve means when the plunger is near the completion of movement in said other direction and thus allow fluid to reverse flow through said second valve and into said housing;
a port in said housing which is in communication with said reservoir;
conduit means to direct said reverse flow to said port;
regulating means to gradually increase the rate of said reverse flow through said port as the plunger is moved toward completion of its movement in said other direction;
a fluid operated ram, said ram comprising a piston rod slidably located within a cylinder, said cylinder being coupled at one end to said second valve means, said cylinder having at its other end a cap with a bore through which the piston rod projects, said bore being coupled by conduit means to said reservoir;
a longitudinally extending bore provided in the inner end of said piston rod;
a passageway leading from the outer peripheral surface of the piston rod and coupled to the inner end of said longitudinal bore, said passageway being positioned so that when the piston rod reaches the limit of its outward movement, it communicates with said reservoir conduit; and
means to close said passageway until the said limit of movement is reached.

12. The combination of claim 11 wherein the closure means is a bush slidingly engaged on a reduced diameter portion at the inner end of said piston rod, the bush normally closing off said passageway which opens into a landing formed at the inner end of said reduced diameter portion, said bush having at least one projection which engages with the internal end of said end cap to move the bush from said landing and open the passageway.

13. The combination of claim 12 wherein the peripheral surface of said bush is flush with the peripheral surface of said piston rod.

14. The combination of claim 13 wherein the central bore in said piston rod extends for a distance greater than the length of said reduced diameter portion.

15. The combination of claim 11 wherein a groove is formed in the inner surface of the end cap bore and is coupled to said reservoir conduit means.

16. The combination of claim 11 wherein the pump housing has at least an opening in the wall thereof via which fluid can be drawn from the reservoir, said first valve means being located to prevent fluid from flowing back into said reservoir through said wall opening, said second valve means being axially disposed from said plunger with said at least one opening being disposed between the said second valve means and the plunger.

17. The combination of claim 16 wheren the first valve means is a flap valve consisting of:

a sealing member retained for restricted axial movement within the housing;

a seating against which the sealing member engages at one limit of its movement; and at least one passageway through said seating which opens between said wall opening and the inside of the housing.

18. The combination of claim 16 wherein:

said conduit means comprises a central bore in said plunger, said bore extending from the end of the plunger within said housing and coupling at its inner end with a cross bore extending through said plunger;

said control means comprises a pin with a longitudinal passageway located within but projecting from said central bore; and said regulating means comprises a tapered recess into which said cross bore opens, the recess being formed in the outer peripheral surface of said plunger, said recess being positioned so that it communicates with said port as the plunger nears the end of movement in said other direction.

19. The combination of claim 18 wherein the pin opens said second valve means when the plunger has reached or nears the limit of movement in the said other direction.

20. The combination of claim 19 wherein the second valve means is opened by said pin when the plunger is moving within the final 25% of its stroke in the said other direction.

* * * * *